United States Patent [19]

Dieling et al.

[11] 4,279,202

[45] Jul. 21, 1981

[54] TORSIONALLY FLEXIBLE RAILWAY TRUCK FRAME

[75] Inventors: Hans Dieling, Felsberg-Rhünda; Manfred Schindehütte, Calden, both of Fed. Rep. of Germany

[73] Assignee: Wegmann & Co., Fed. Rep. of Germany

[21] Appl. No.: 48,866

[22] Filed: Jun. 15, 1979

[30] Foreign Application Priority Data

Jun. 15, 1978 [DE] Fed. Rep. of Germany ..... 2826155

[51] Int. Cl.[3] ..... B61F 5/00; B61F 5/24; B61F 5/52

[52] U.S. Cl. ..... 105/206 R; 105/175 A; 105/182 R; 105/199 A; 105/206 A; 105/208

[58] Field of Search ..... 105/182 R, 206 A, 206 R, 105/208

[56] References Cited

U.S. PATENT DOCUMENTS

| | | | |
|---|---|---|---|
| 684,837 | 10/1901 | Maltby | 105/208 |
| 1,623,036 | 4/1927 | Anderson | 105/208 X |
| 2,186,008 | 1/1940 | Chapman | 105/206 R |
| 2,201,861 | 5/1940 | Hanna | 105/182 R X |
| 2,237,757 | 4/1941 | Eksergian et al. | 105/208 X |
| 2,594,734 | 4/1952 | Cripe | 105/182 R X |
| 2,637,279 | 5/1953 | Charlton et al. | 105/206 A X |

*Primary Examiner*—John P. Silverstrim
*Assistant Examiner*—Howard Beltran
*Attorney, Agent, or Firm*—Sprung, Felfe, Horn, Lynch & Kramer

[57] ABSTRACT

A swivel truck frame of high torsional flexibility for rail vehicles is provided comprising a pair of generally straight longitudinal beams running parallel to one another, said longitudinal beams connected to one another by parallel running crossbeams to define a rectangular frame, said crossbeams being welded to said longitudinal beams, said crossbeams being disposed under said longitudinal beams, the lower chords of said longitudinal beams being welded to the upper chords of said crossbeams, said longitudinal beams being further interconnected by at least one middle crossbeam disposed between said parallel running crossbeams.

12 Claims, 10 Drawing Figures

TORSIONALLY FLEXIBLE RAILWAY TRUCK FRAME

BACKGROUND OF THE INVENTION

1. Field of the Invention

This invention relates to truck frames for use in rail vehicles having high torsional flexibility comprising a pair of longitudinal beams joined by crossbeams wherein the crossbeams' upper chords are welded to the lower chords of the longitudinal beams, the truck frame having middle crossbeams joining the parallel running longitudinal beams between the end crossbeams.

2. Discussion of Prior Art

It is known that truck frames of high torsional flexibility are used in rail vehicles. These highly flexible trucks have the advantage that the primary spring between the wheel axle bearing and the truck frame can be relatively stiff, and under certain circumstances can be entirely dispensed with. In a highly flexible truck, if the points of contact of the wheels with the rails are in a horizontal plane, the wheel loading will be equal at all points. Even if one point is not in this plane, as is the case, for example, in ramps leading up to superelevations in the rails, only very slight differences occur in the wheel loading, since the truck offers little resistance to such distortions. There is no danger, therefore, that a wheel might part from the rail.

These known truck frames of high torsional flexibility were welded together from longitudinal and transverse beams of low resistance to torsion such that flexibility will not be impaired at the welds, it being necessary for that purpose that the longitudinal movements of the chords against one another, produced by the twisting of a beam, will not be restricted. In the known swivel truck frame, this is achieved by making the beams or at least their upper or lower chords offset. In particular, the longitudinal beams are offset downwardly, resulting in the possibility of making the ends of the longitudinal beams more torsion-resistant so as to prevent the ends from twisting in the event of a transverse force acting on the set of wheels. The crossbeams also are either offset as a whole, or at least their lower chords are curved to an arc which is able to absorb the shear movements, and the end is welded to the longitudinal beam. The truck frames are constructed in an H-like configuration, since due to the welding of crossbeams to the two face sides the torsional flexibility of the truck frame would be impaired.

Trucks of high torsional flexibility have proven to be very satisfactory. They are suitable for all kinds of rail equipment, namely passenger cars, short-haul cars and rail cars, streetcars and freight cars. They have very good dynamic characteristics and are suitable therefore even for high speeds. They can be made relatively light, and they make possible savings in the primary spring.

On account of these many different uses for trucks of high torsional flexibility, it has been necessary constantly to create new designs, because the requirements as regards the length and width of the truck frame, and its load carrying capacity, etc., vary greatly. The offset shape of the beams made it necessary every time to redesign the entire truck. Even a need to increase the distance between the wheel axles by 30 cm used to necessitate a large investment in a completely new design.

It is an object of this invention to provide a swivel truck frame which can be adapted to various requirements regarding dimensions, load carrying capacity and the arrangement of springs, brakes and, in some cases, motors and other additional equipment, without each time having to perform a complete new design with all of the detail drawings necessary for that purpose.

SUMMARY OF THE INVENTION

The foregoing objects are provided by a swivel truck frame of high torsional flexibility for rail vehicles comprising a pair of generally straight longitudinal beams running parallel to one another, said longitudinal beams connected to one another by parallel running crossbeams to define a rectangular frame, said crossbeams being welded to said longitudinal beams, said crossbeams being disposed under said longitudinal beams, the lower chords of said longitudinal beams being welded to the upper chords of said crossbeams, said longitudinal beams being further interconnected by at least one middle crossbeam disposed between said parallel running crossbeams. The crossbeams are also preferably straight beams. Those beams are straight beams in the meaning of the invention in which at least the chords which are welded to the chords of the other beams are welded straight, that is, not offset. Any beam having an open cross-section, that is, especially beams having a T, I or U-shaped cross-section or longitudinally slotted box beams, can be used as beams of high torsional flexibility. Each longitudinal beam can be a U-beam, especially a pair of facing U-beams which can be interconnected to form a box, while the crossbeams can be I-beams. Since the lower chords of the longitudinal beams are welded to the upper chords of the crossbeams, the cross-sections of all beams are free at the beam ends and the shear movements occurring when the beams are twisted are not hampered. Thus, it becomes possible to change from the H frame used hitherto to an H frame having end crossbeams or to the rectangular frame, or to provide the frame with additional crossbeams in the middle without in the least imparing the torsional flexibility of the frame. The corner stiffness can be substantially assured by the face welding of the upper chord of the crossbeam to the lower chords of the longitudinal beams, especially if two parallel crossbeams are provided in the middle of the frame. The corner stiffness, however, can also be assured by welding a plate, hereinafter to be called the shear plate, at least approximately at the level of the lower chord of the longitudinal beams.

In the swivel truck frame of the invention, if the points of contact between the wheels and the rails are in one plane, the lower chords of the longitudinal beams define a plane which is warped in space by the lifting of a wheel.

Since straight beams are used for the longitudinal beams and in some cases also for the crossbeams, the truck frame can easily be adapted to any requirement by appropriately selecting the length of the longitudinal beams and the length of the crossbeams. On the other hand, it is also possible, without any other change in design, if a higher load bearing capacity is required, to increase the height of the longitudinal beams and/or the height of the crossbeams, especially of the middle crossbeams. In the case of the longitudinal beams the load carrying capacity can be increased by welding additional open beams between the wheel mounts underneath the lower chords. In the case of the crossbeams the same reinforcement is possible, though it is simple in the case of crossbeams to increase the height of the center member, the upper chord being able to be offset upwardly or the lower chord to be offset downwardly. In these cases the crossbeams are no longer straight beams. The flexibility of the frame, however, is assured by the fact that the points of attachment of the upper chords of the crossbeam are situated at the level of the lower chords of the longitudinal beams and are welded to the latter. Trucks having crossbeams made in this configuration can also easily be adapted to changes in design.

For the attachment of the wheel axle bearings, appropriate fastening means, such as brackets or the like, can be welded at the desired axle spacing to the bottom chord of the longitudinal beams. However, to keep the profile of the truck as low as possible, it is desirable to cut openings into the longitudinal beams to receive the axle bearings. The position of these openings also is variable without changing the rest of the design.

The truck frames of the invention can also be used for motorized swivel trucks. In this case the front beams can be used for the mounting of the motor. So that the flexibility of the truck may not be impaired by the motor mount, it is desirable to mount beams parallel with and rotatable on the crossbeams, and to mount the motor at one or two points thereon. When the truck frame twists, these parallel beams will tilt correspondingly without in any way impairing torsional flexibility.

BRIEF DESCRIPTION OF DRAWINGS

Examples of the embodiment of the invention are represented in the drawings, wherein.

DESCRIPTION OF SPECIFIC EMBODIMENTS

Figure 1:
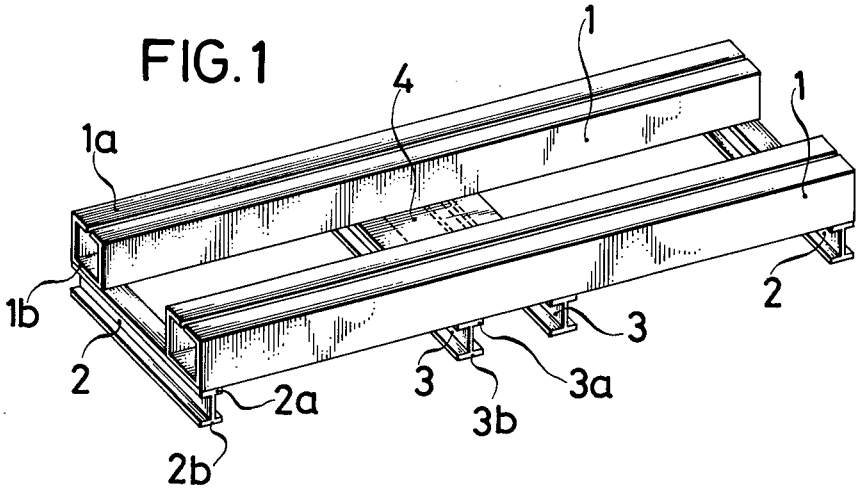
FIG. 1 is a perspective view of a swivel truck frame.

As seen in FIG. 1, the swivel truck frame consists of the two longitudinal beams 1 which here are represented as box sections having slotted tops, the end crossbeams 2, which are I-beams, and the middle crossbeams 3 which are also I-beams. The upper chords 2*a* and 3*a* of these crossbeams are welded to the lower chords 1*b* of the longitudinal beams. All of the beams are open-ended, as clearly indicated in FIG. 1, so that the shear movements that occur when the frame is twisted are not impeded in any of the beams. The upper chord 3*a* of the middle crossbeams 3 can be joined together to form a shear plate 4 to improve the corner stiffness of the truck frame.

This basic form of the swivel truck frame can easily be modified without changing the design. For example, the length of the longitudinal beams 1 can be increased or reduced, thereby changing the overall length of the truck frame. Likewise, the length of the crossbeams can be changed, either for the purpose of adapting the truck to a different track width, or to change over from a truck having longitudinal beams situated outside of the wheels to one having them inside of the wheels. Also, however, the middle beams 3 can be lengthened laterally beyond the longitudinal beams 1, for example, if it is desired, say, to provide additional parts thereon. For example, such lengthened middle crossbeams might also serve for mounting the secondary springs outside of the longitudinal beams instead of between them, which may be desirable in street cars, for example, in which a movable beam is required on account of the extreme swiveling of the trucks in tight curves, or in trucks in which the longitudinal beams are situated inside of the wheels.

In the swivel truck of FIG. 2, the longitudinal beams 1 are reinforced between the wheel bearings 6 by additional beams 7 which are beams of open cross section disposed below the lower chords of the longitudinal beams.

For the mounting of the wheel axle bearings 6, cutouts 5 are made in the longitudinal beams. These cutouts do not impair the torsional flexibility of the truck as a whole, but they increase the torsional flexibility of the ends of the longitudinal beams 1 extending beyond the wheel axle bearings. However, this undesired torsion of the ends of the longitudinal beams, which can be produced by transverse forces exerted by the wheel axle bearings, is counteracted by the crossbeams 2 which are welded to the lower chord of the longitudinal beams 1, and thus prevent any undesirable torsion of the longitudinal beams which is not necessary for the torsional flexing of the frame.

Figure 2:
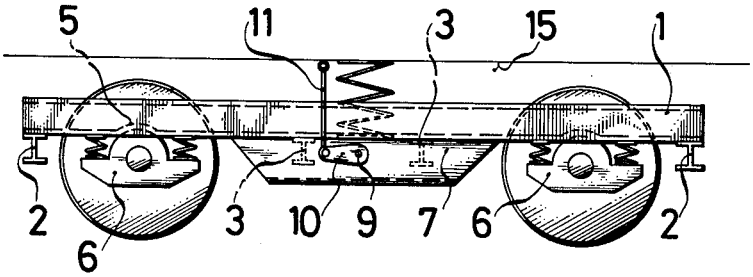
FIG. 2 is a side view of a swivel truck.
Figure 3:
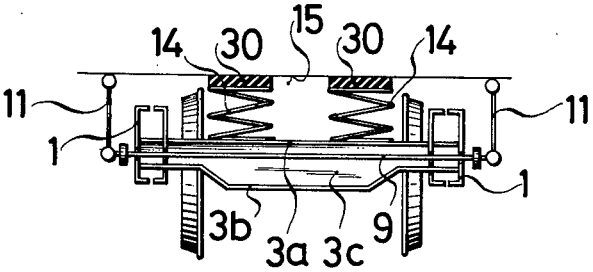
FIG. 3 is a cross-sectional view of the swivel truck of FIG. 2.
Figure 4:
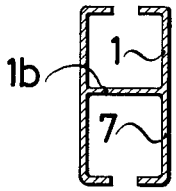
FIGS. 4 to 9 represent a variety of cross-sectional profiles of reinforced longitudinal beams.
Figure 5:
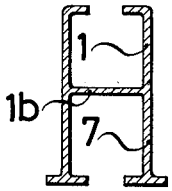
Figure 6:
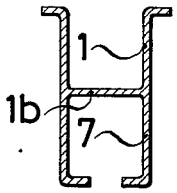
Figure 7:
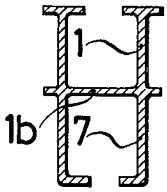

In the truck of FIG. 2, two coil springs 14 are provided as secondary springs, as represented in cross section in FIG. 3. To reduce noise, rubber elements 30 can be inserted at the upper ends of the coil springs between the latter and the bottom 15 of the car body. The short distance between the springs 14 results in poor stability of the car body against rocking. To stabilize the car body against the truck, a stabilizer means is provided in a known manner, as represented in FIGS. 2 and 3, consisting of a torsion bar 9, the levers 10 and the connecting rods 11. Either the torsion bar can be fastened to the truck, as represented, and the ends of the connecting rods to the car body, or, vice versa, the torsion bar can be fastened to the car body and the ends of the rods to the truck, in a manner which is also known. Instead of the coil springs, air springs can also be used.

FIG. 3 furthermore shows how the crossbeams 3 can be strengthened if necessary. The lower chords 3*b* of the crossbeams 3 are offset slightly downward, so that the webs 3*c* are correspondingly wider, i.e., they extend further downwardly from the upper chord. Instead, or simultaneously, the upper chord can be offset upwardly.

Figure 8:
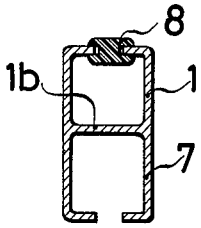
Figure 9:
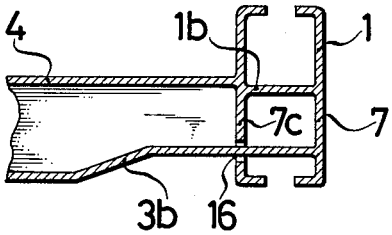

FIGS. 4 to 9 show a variety of cross-sectional shapes for longitudinal beams combined with likewise open reinforcements 7 situated beneath them. In all cases, as shown in FIG. 8, the longitudinal slot of the open section can be closed by an elastomeric material 8. FIG. 9 shows how the shear plate 4 can be welded to a longitudinal beam 1 having a reinforcing section 7. For reasons relating to the welding art, the shear plate 4 is not at precisely the same level as the lower chord 1*b* of the longitudinal beam, which here is simultaneously the upper chord of the reinforcement 7. The slight offset between the shear plate 4 and the lower chord 1*b* in no way impairs the torsional flexibility of the truck frame. Here, too, as in the case of the truck of FIG. 3, the lower chord 3*b* of the crossbeam 3 can be offset, the shear movements of the lower chord being absorbed by this offset. The bottom chord 3*b* can in this case be welded to the sidewall 7*c* of the reinforcement 7. To the extent that the shear movement of the lower chord 3*b* is not absorbed by an offset, the sidewall 7*c* will, if the lower chord is welded to this sidewall, be bowed slightly in and out as the truck twists, so that the torsional flexibility of the crossbeam will not be markedly impaired. The lower chord 3*b*, however, can also be brought through a slot 16 in the sidewall 7*c* of the reinforcement 7 and welded to the opposite wall. In this case the shear movements are absorbed both by the flexing of the lower chord 3*b* and by the bending of this wall.

Figure 10:
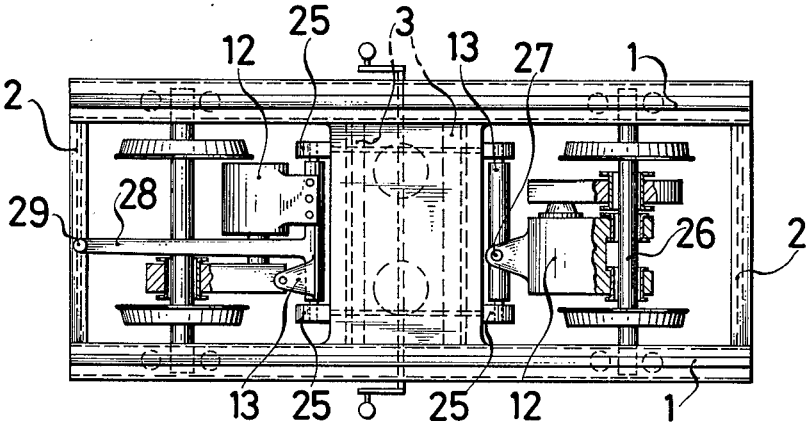
FIG. 10 is a top view of a motorized swivel truck.

FIG. 10 is a top view of a motorized swivel truck having a frame in accordance with the invention. For the suspension of the motor, beams 13 are provided on the middle crossbeams 3 parallel thereto in bearings 25, so that they can turn about their own axis and, if a torsional flexing of the truck frame changes the level relationship between the bearings 25, they can also tilt slightly. In the right half of FIG. 10 is shown how a motor 12 can be mounted on the wheel axis 26 on the one hand and at a point 27 on the beam 13 by means of bearings. The left half of FIG. 10 shows the mounting of a truck motor, in which the additional beam 13 is formed by an arm 28 into a T-shaped member on which the motor 12 is fastened. In this manner a three-point mounting in the two bearings 25 and at the fastening point 29 of arm 28 is achieved, which does not impair the torsional flexibility of the swivel truck.

The advantages of the swivel truck frame of the invention are apparent particularly if one considers the work of the draftsman. In working drawings, all dimensions have to be given in units of length, usually in millimeters. In the case of the truck of the invention, it is possible to give certain dimensions, such as the overall length of the frame or of the longitudinal beams, the axle spacing, the track width or length of the crossbeams and a number of other data symbolically, as for example by letters x, y and z in the drawing, and then alongside the drawing, together with the usual list of parts, to provide a table into which the numerical values corresponding to the symbols can be entered in each individual case. The draftsman, who at the present time has to prepare a complete new set of drawings giving all dimensions even if only one dimension is changed, can, in the case of the truck of the invention, limit himself to inserting the desired dimensions into this table in each individual case, while all other dimensions in the drawing remain unaltered. What results, however, is not only a simplification of the draftsman's work, but also a simplification of manufacture, because for the production of a swivel truck only the longitudinal beams and crossbeams have to be cut to the required lengths and welded together accordingly. If crossbeams having offset upper or lower chords are called for, they can be custom-welded together in the specified lengths. If the longitudinal beams are to have cutouts for the wheel bearings, these cutouts can be made regardless of how long the longitudinal beams are, at the points required by the distance between the axles, and the joining pieces can be welded into these cutouts. All other components commonly required in a swivel truck, including not only the axle bearings, the primary and secondary springs, and the stabilizer or torsion bar, if any, but also all other parts, such as brakes, lighting dynamos etc., can be mounted on the swivel truck thus simply manufactured, so that the simple design of the truck frame, consisting essentially of straight pieces, opens up the possibility of putting together a truck by a modular system, without having to do drafting work all over again each time.

We claim:

1. A swivel truck frame of high torsional flexibility for rail vehicles comprising a pair of straight longitudinal box beams having longitudinal slotted tops running parallel to one another, said longitudinal beams connected to one another by parallel running crossbeams to define a rectangular frame, said crossbeams being welded to said longitudinal beams, said crossbeams being disposed under said longitudinal beams, the lower chords of said longitudinal beams being welded to the upper chords of said crossbeams, said longitudinal beams being further interconnected by at least one middle crossbeam disposed between said parallel running crossbeams.

2. A swivel truck frame according to claim 1 wherein said parallel running crossbeams have an open configuration.

3. A swivel truck frame according to claim 1 wherein there are two parallel crossbeams situated between said longitudinal beams at least approximately at the level of the lower chords of the longitudinal beams between the parallel running beams, said beams disposed between the parallel running beams being parallel to one another and being welded in the middle.

4. A swivel truck frame according to claim 1 wherein a plate is situated between said longitudinal beams at least approximately at the level of the lower chords of said longitudinal beams, said plate being welded thereto.

5. A swivel truck frame according to claim 1 wherein said longitudinal beams have cut-outs to receive wheel bearings.

6. A swivel truck frame according to claim 1 wherein said truck frame has wheel bearings attached thereto and in the region of said wheel bearings along each longitudinal beam there is an additional slotted beam situated beneath the lower chord thereof.

7. A swivel truck frame according to claim 1 wherein the crossbeams disposed between the parallel running crossbeams are reinforced in the region between the longitudinal means by virtue of an increased width of the central web thereof.

8. A swivel truck frame according to claim 1 wherein there are a plurality of middle crossbeams between said parallel running crossbeams which are welded to said longitudinal beams and to at least one of said middle crossbeams there is rotatably mounted a motor support beam running generally parallel thereto, said motor support beam adapted to mount a motor.

9. A swivel truck frame according to claim 1 wherein said parallel running crossbeams are straight crossbeams.

10. A swivel truck frame according to claim 9 wherein said parallel running crossbeams have an open configuration.

11. A swivel truck frame according to claim 10 wherein said straight longitudinal running beams are at least partially slotted.

12. A swivel truck frame according to claim 11 wherein the lower chords of said longitudinally running beams extend over the entire length of the longitudinal beams.

* * * * *